US008632322B2

(12) United States Patent
Able et al.

(10) Patent No.: US 8,632,322 B2
(45) Date of Patent: Jan. 21, 2014

(54) PLUNGER PUMP WITH ATMOSPHERIC BELLOWS

(75) Inventors: Stephen D. Able, Bethlehem, PA (US); Jana Able, legal representative, Bethlehem, PA (US); Michael Conti, Bryan, OH (US); Kerry G. Vonalt, Edgerton, OH (US)

(73) Assignee: Ingersoll-Rand Company, Davidson, NC (US)

( * ) Notice: Subject to any disclaimer, the term of this patent is extended or adjusted under 35 U.S.C. 154(b) by 1944 days.

(21) Appl. No.: 11/342,431

(22) Filed: Jan. 30, 2006

(65) Prior Publication Data

US 2007/0178000 A1 Aug. 2, 2007

(51) Int. Cl.
*F04B 39/10* (2006.01)

(52) U.S. Cl.
USPC ..... 417/555.1; 417/403; 417/404

(58) Field of Classification Search
USPC ..... 417/555.1, 403, 404
See application file for complete search history.

(56) References Cited

U.S. PATENT DOCUMENTS

| | | | | |
|---|---|---|---|---|
| 2,170,574 | A | | 8/1935 | Sauzedde |
| 3,645,649 | A | | 2/1972 | Beale |
| 3,902,404 | A | | 9/1975 | Breit |
| 3,990,816 | A | | 11/1976 | Köhler |
| 4,079,894 | A | | 3/1978 | Harjar et al. |
| 4,116,115 | A | | 9/1978 | Gross et al. |
| 4,126,321 | A | | 11/1978 | Harjar et al. |
| 4,268,042 | A | | 5/1981 | Borlan |
| 4,378,119 | A | * | 3/1983 | Luxford et al. ..... 277/389 |
| 4,402,186 | A | | 9/1983 | Feustel et al. |
| 4,436,494 | A | * | 3/1984 | Yamaizumi ..... 417/403 |
| 4,438,632 | A | | 3/1984 | Lessard et al. |
| 4,456,267 | A | | 6/1984 | Bacharach |
| 4,463,663 | A | * | 8/1984 | Hanson et al. ..... 92/80 |
| 4,488,853 | A | | 12/1984 | Benson |
| 4,556,369 | A | | 12/1985 | Braun |
| 4,583,531 | A | | 4/1986 | Mattchen |
| 4,594,057 | A | | 6/1986 | Morgan |
| 4,732,544 | A | * | 3/1988 | Kurosawa et al. ..... 417/222.2 |
| 4,769,992 | A | | 9/1988 | Harada et al. |
| 4,900,233 | A | | 2/1990 | Ripley |
| 5,029,401 | A | | 7/1991 | Masom |
| 5,058,861 | A | | 10/1991 | Baumann |
| 5,094,596 | A | | 3/1992 | Erwin et al. |
| 5,152,540 | A | | 10/1992 | Kuze |
| 5,277,342 | A | | 1/1994 | Dickau et al. |
| 5,410,947 | A | | 5/1995 | Garnjost |
| 5,415,531 | A | | 5/1995 | Cavanaugh |

(Continued)

FOREIGN PATENT DOCUMENTS

| | | |
|---|---|---|
| EP | 0276623 A2 | 8/1988 |
| FR | 2695965 A1 | 3/1994 |

*Primary Examiner* — Charles Freay
*Assistant Examiner* — Philip Stimpert
(74) *Attorney, Agent, or Firm* — Michael Best & Friedrich LLP

(57) ABSTRACT

A plunger pump including an airtight bellows surrounding a portion of a drive shaft to protect the drive shaft and associated seals and/or bearings from harmful fluids that are being pumped. No counter-pressure fluid exists inside the bellows, other than air, and the bellows is sufficiently rigid to withstand the pressure of the pumped fluid without collapsing. The interior of the bellows is in fluid communication with the atmosphere, negating the need for a reservoir to accommodate varying quantities of counter-pressure fluid as the pump operates.

3 Claims, 3 Drawing Sheets

(56) References Cited

U.S. PATENT DOCUMENTS

| | | | | |
|---|---|---|---|---|
| 5,525,047 | A | | 6/1996 | Sternenberg et al. |
| 5,655,778 | A | | 8/1997 | Cavanaugh |
| 5,685,923 | A | * | 11/1997 | Takata et al. ..... 148/325 |
| 5,941,531 | A | | 8/1999 | Parker et al. |
| 5,992,296 | A | | 11/1999 | Murata |
| 6,027,459 | A | | 2/2000 | Shain et al. |
| 6,129,526 | A | | 10/2000 | Kelly |
| 6,135,093 | A | | 10/2000 | Kikuchi et al. |
| 6,237,423 | B1 | | 5/2001 | Zey |
| 6,345,963 | B1 | | 2/2002 | Thomin et al. |
| 6,505,838 | B1 | | 1/2003 | Cavaliere |

* cited by examiner

PLUNGER PUMP WITH ATMOSPHERIC BELLOWS

BACKGROUND

The present invention relates to a plunger pump in which the interior of the bellows structure is substantially at atmospheric pressure.

U.S. Pat. No. 4,436,494 teaches a plunger pump having a bellows surrounding a plunger. The bellows is constructed of flourine plastics and the like. When the pump operates, the bellows extends and contracts within the housing of the pump, and separates the fluid to be pumped from the plunger. To offset the pressure exerted on the outer surface of the bellows by the fluid being pumped through the pump, the bellows is filled with a liquid such as oil and the like. The extension and contraction of the bellows changes the volume within the bellows, which either forces oil out of the bellows or draws oil into the bellows. Variations in the volume in the bellows is matched with a variation of volume in a liquid filled portion of an upper case portion due to the simultaneous movements of a socket constituting a part of the plunger.

SUMMARY

The present invention provides an improvement over the plunger pump disclosed in U.S. Pat. No. 4,436,494. The prior art bellows is constructed of a material that does not have predictable fatigue characteristics. Maintenance is made difficult by the unpredictable failure of the prior art bellows. Also, should there be a failure of the prior art bellows, there is a risk of contamination of the fluid being pumped with the oil in the bellows. The present invention utilizes a plunger pump having a bellows that communicates with atmospheric air and is not filled with oil. This enables a plunger pump to be constructed without a variable volume accumulator to handle oil displaced from the inside of the bellows during operation.

In one embodiment, the invention provides a pump comprising a housing defining an inner cavity and having an inlet port, an outlet port, and a bellows port. A first valve permits one-way flow of fluid into the inner cavity through the inlet port. A drive rod is supported for reciprocal movement within the inner cavity. A bellows within the inner cavity surrounds a portion of the drive rod, and extends and contracts in response to the reciprocal movement of the drive rod. A second valve is interconnected with the drive rod for reciprocal movement within the inner cavity and permits one-way flow of fluid from a first side of the second valve to a second side of the second valve. The inner cavity is divided into an inlet portion on the first side of the second valve, an outlet portion between the second side of the second valve and an outer surface of the bellows, and an atmospheric portion within the bellows. The inlet port is adapted for communication between the inlet portion and a source of fluid to be pumped, the outlet port is adapted for communication between the outlet portion and a receptacle for pumped fluid, and the bellows port is adapted for communication between the atmospheric portion and the atmosphere. The bellows is substantially airtight and separates the outlet portion of the inner cavity from the atmospheric portion. Air is drawn into and displaced from the atmospheric portion of the inner cavity in response to respective extension and contraction of the bellows.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings, respectively. Further, "connected" and "coupled" are not restricted to physical or mechanical connections or couplings.

Figure 1:
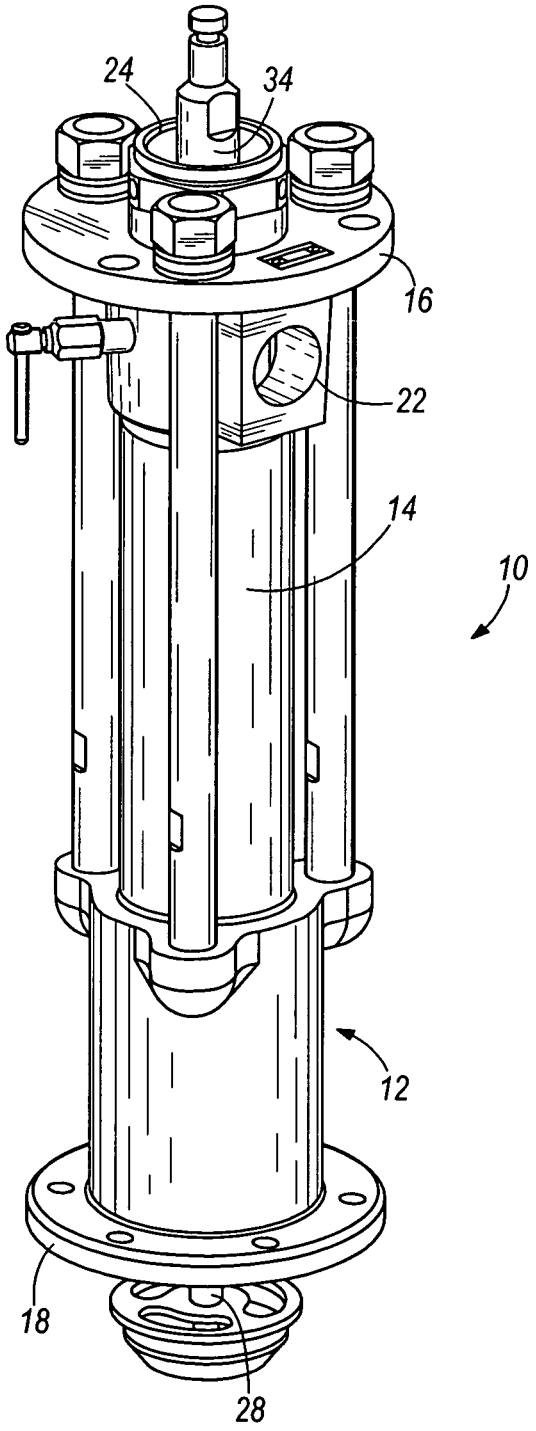
FIG. 1 is a perspective view of a pump embodying the invention.

FIG. 1 illustrates a plunger pump 10 that includes a housing 12. The housing 12 includes a cylindrical side wall 14 and top and bottom flanges, 16, 18, respectively. The top flange 16 is adapted to have a prime mover 17 mounted to it. The prime mover 17 may be, for example, a motor operating under the influence of compressed air. In other embodiments and constructions, the prime mover may be of a type that operates under the influence of electricity, internal combustion, or another motive force. The bottom flange 18 is adapted to be mounted to a wiper 19 that is positioned within a container of fluid to be pumped by the pump 10. For example, the wiper 19 may be positioned within a container of UV/EB ink. The bottom flange 18 surrounds an aperture 21 defined by the wiper 19. The aperture 21 places an inlet port 20 in fluid communication with the fluid to be pumped. The size of the wiper 19 matches the size of the container of fluid being pumped. The wiper 19 extends across the container and forms a fluid-tight sliding seal with the inside surface of the container. The housing 12 also includes an outlet port 22 near the top of the side wall 14, and a bellows port 24 in the top flange 16.

Figure 2:
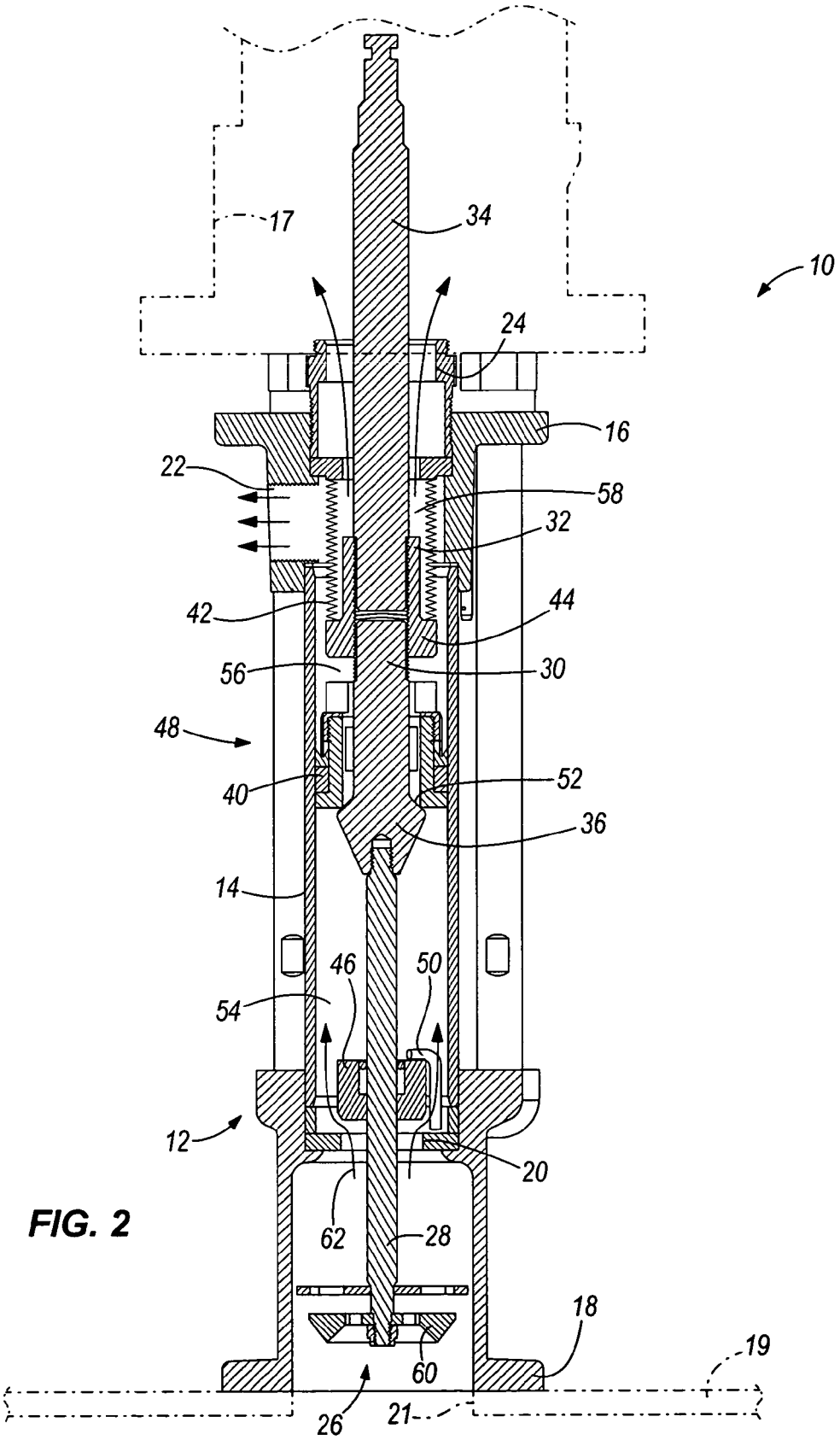
FIG. 2 is a cross-section view of the pump in first working position.
Figure 3:
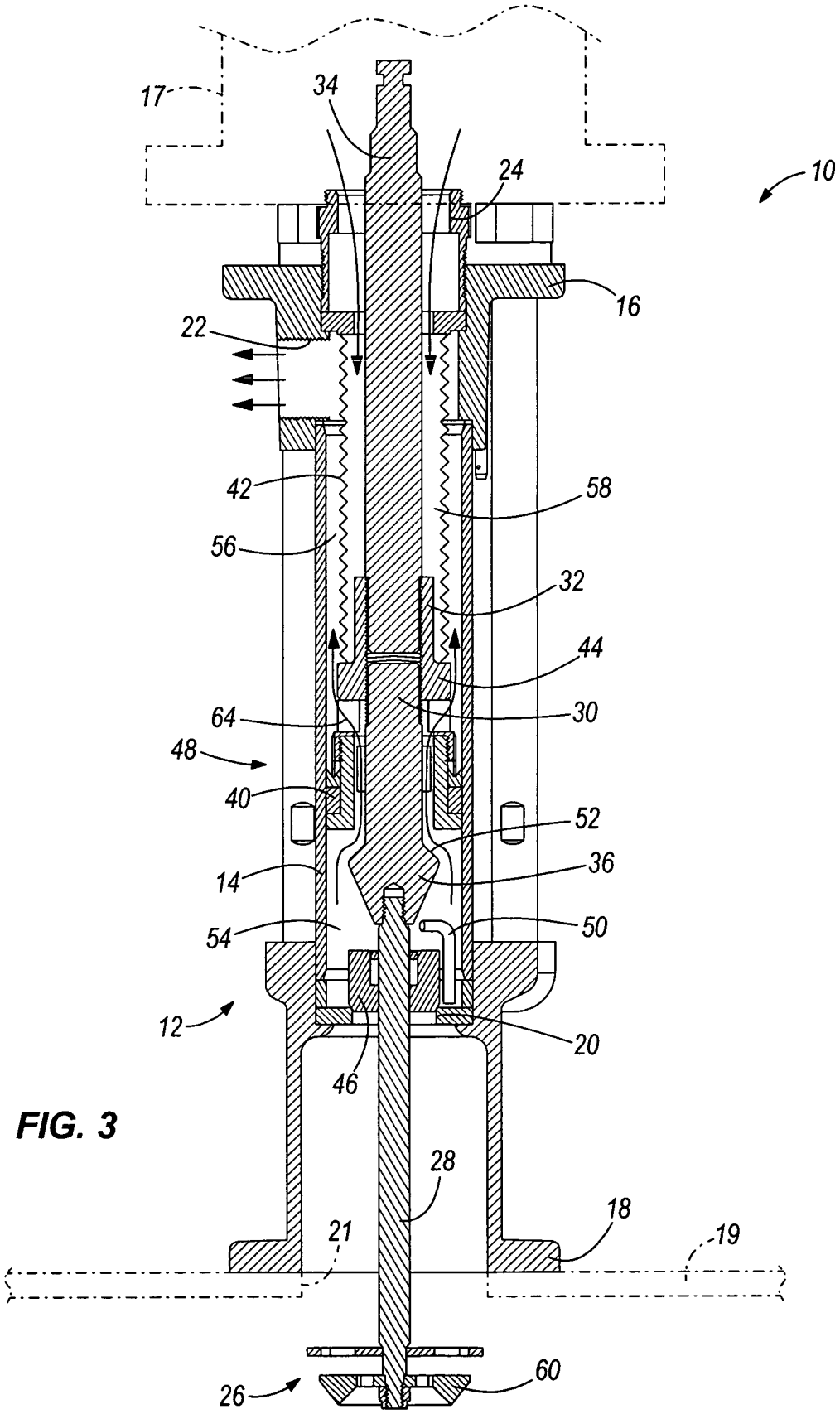
FIG. 3 is a cross-section view of the pump in a second working position.

With reference to FIGS. 2 and 3, a plunger assembly 26 extends through the housing 12 and includes a primer shaft 28 extending through the inlet port 20, an intermediate shaft 30, a coupler 32, and a drive shaft 34 extending through the bellows port 24. The drive shaft 34 and intermediate shaft 30 thread into the coupler 32, and the primer shaft 28 threads into an enlarged end 36 of the intermediate shaft 30. The primer shaft 28 and drive shaft 34 are partially supported for reciprocating movement by bearing 40. A bellows 42 surrounds a portion of the drive shaft 34 extending into the housing 12 and is airtightly sealed to an enlarged-diameter end 44 of the coupler 32 at one end and to the top flange 16 at the other end.

A first check valve 46 is disposed on the primer shaft 28 and a second check valve 48 is disposed on the intermediate shaft 30. Both of the first and second valves 46, 48, are one-way valves that, in the illustrated embodiment, permit the flow of fluid only upwardly through the pump 10. A valve stop 50 is mounted to the bottom flange 18, and the first check valve 46 is movable between abutment with the valve stop 50 (as in FIG. 2) and abutment with the inlet port 20 (as in FIG. 3). When the first check valve 46 is in abutment with the inlet port 20, it acts as a bearing to support the primer shaft 28. The enlarged end 36 of the intermediate shaft 30 includes a generally conical surface 52. The second check valve 48 is slidable along the intermediate shaft 30 into abutment with the conical surface 52 (as in FIG. 2) and abutment with the enlarged-diameter end 44 of the coupler 32 (as in FIG. 3).

The housing 12 defines an inner cavity that is divided into three portions: an inlet portion 54 on one side of the second check valve 48, an outlet portion 56 on the other side of the second check valve 48 and around the outside of the bellows 42, and an atmospheric portion 58 within the bellows 42. The inlet portion 54 communicates with the container of fluid through the inlet port 20 and through the aperture 21 in the wiper 19, the outlet portion 56 communicates with a receptacle into which the fluid is pumped through the outlet port 22, and the atmospheric portion 58 communicates with the atmosphere through the bellows port 24.

In operation, an external downward force is applied to the pump 10. The downward force may come from a hydraulic cylinder, one or more biasing members, or any other mechanism capable of applying constant controllable force to the entire pump 10. The downward force will force the wiper 19 into the container of fluid. Since the wiper 19 extends across the container and forms a fluid-tight sliding seal with the inner surface of the container of fluid, fluid rises through the aperture 21 to the inlet port 20. In some embodiments, the bottom flange 18 is coupled to a source of fluid under sufficient pressure that the fluid is forced to the inlet port 20 without having to use a wiper 19.

Also during operation, the prime mover 17 is interconnected with an end of the drive shaft 34 and causes cyclical reciprocation of the plunger assembly 26. On the upward stroke (i.e. movement of the plunger assembly 26 from the position illustrated in FIG. 3 to the position illustrated in FIG. 2), suction is created within the inlet portion 54 when the second valve 48 is moved upward within the housing 12 under the influence of the intermediate rod 30. The suction raises the first valve 46 into abutment against the valve stop 50, and draws fluid into the inlet portion 54 from the container of fluid. A primer button 60 is secured to a free end of the primer shaft 28 to feed fluid into the inlet portion 54 during the first few strokes of pump 10 operation when there is insufficient suction to draw the fluid in. During this upward stroke, any fluid in the outlet portion 56 is forced out of the outlet port 22 into the receptacle for the fluid. The arrows in FIG. 2 illustrate fluid movement during this upward stroke.

On the downward stroke (i.e., movement of the plunger assembly 26 from the position illustrated in FIG. 2 to the position illustrated in FIG. 3), the first valve 46 is forced down by fluid pressure in the inlet portion 54 and blocks the inlet port 20. The second valve 48 rides up the intermediate shaft 30 and abuts the enlarged end 44 of the coupler 32. Fluid in the inlet portion 54 is forced into the outlet portion 56 through the second valve 48 as the drive shaft 34 continues to force the second valve 48 down. Due to the expanding volume occupied by the bellows 42, the volume of fluid entering the outlet portion 56 is greater than the volume of the outlet portion 56. This forces some of the fluid entering the outlet portion 56 to flow through the outlet port 22 into the receptacle for the fluid. Fluid flow during the downward stroke is illustrated with arrows in FIG. 3.

When in abutment with the bottom flange 18, the first check valve 46 blocks the inlet port 20 to prevent the flow of fluid out of the inlet port 20. However, when the first check valve 46 lifts off the bottom flange 18 and abuts the valve stop 50, a flow path 62 for fluid from the container of fluid into the inlet portion 54 of the inner cavity of the housing 12 is opened. When the second valve 48 abuts the conical surface 52 of the intermediate shaft 30, it prevents the flow of fluid from the outlet portion 56 of the inner cavity into the inlet portion 54. However, when the second valve 48 lifts off the conical surface 52, it opens a flow path 64 around an end 36 of the intermediate shaft 30, through the second check valve 48, and into the outlet 56 portion of the inner cavity.

During operation, the bellows 42 extends and contracts as the prime mover 17 inserts and retracts the drive shaft 34 with respect to the housing 12. Because the interior of the bellows 42 (i.e., the atmospheric portion 58 of the inner cavity of the housing 12) communicates with the atmosphere through the bearing 40 in the bellows port 24, any air drawn into or displaced from the atmospheric portion 58 is sucked in from or exhausted to the atmosphere. No separate accumulator or other device is required to hold fluid displaced from the interior of the bellows 42. Also, should the bellows 42 develop small cracks but continue to pump fluid out of the outlet 22 (albeit less efficiently), there is no fluid (other than air) in the bellows 42 that would leak into and contaminate the pumped fluid prior to discovery of the flaw in the bellows 42.

The bellows 42 is constructed of a material that has sufficient rigidity to maintain its shape while forcing fluid into and out of the outlet portion 56, but that has sufficient flexibility to be formed into a bellows 42 shape. The material should be chemically non-reactive with the fluids being pumped. Also, the material should have fatigue characteristics that enable its cycles to failure to be accurately predicted, so the bellows 42 can be replaced prior to failure. One example of a material that may be used for the bellows 42 is stainless steel.

Various features of the embodiments are set forth in the following claims.

What is claimed is:

1. A pump comprising:

a housing defining an inner cavity and having an inlet port, an outlet port, and a bellows port;

a first valve permitting one-way flow of fluid into the inner cavity through the inlet port;

a drive rod supported for reciprocal movement within the inner cavity;

a bellows within the inner cavity and surrounding a portion of the drive rod, the bellows extending and contracting in response to the reciprocal movement of the drive rod; and a second valve interconnected with the drive rod for reciprocal movement within the inner cavity and permitting one-way flow of fluid from a first side of the second valve to a second side of the second valve;

wherein the inner cavity is divided into an inlet portion on the first side of the second valve, an outlet portion between the second side of the second valve and an outer surface of the bellows, and an atmospheric portion within the bellows;

wherein the inlet port is adapted for communication between the inlet portion and a source of fluid to be pumped, the outlet port is adapted for communication between the outlet portion and a receptacle for pumped fluid, and the bellows port is adapted for communication between the atmospheric portion and the atmosphere;

wherein the bellows substantially airtightly separates the outlet portion of the inner cavity from the atmospheric portion; and wherein air is drawn into and displaced from the atmospheric portion of the inner cavity in response to respective extension and contraction of the bellows.

2. The pump of claim 1, wherein the bellows is constructed of a material having sufficient rigidity to withstand the pressure within the outlet portion of the inner cavity and having predictable fatigue characteristics.

3. The pump of claim 1, wherein the bellows is constructed of stainless steel.

* * * * *